US010987934B2

(12) United States Patent
Naito

(10) Patent No.: US 10,987,934 B2
(45) Date of Patent: Apr. 27, 2021

(54) SEALING STRUCTURE AND LIQUID STORAGE CONTAINER

(71) Applicant: SEIKO EPSON CORPORATION, Tokyo (JP)

(72) Inventor: Naoki Naito, Ikeda-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/746,008

(22) Filed: Jan. 17, 2020

(65) Prior Publication Data

US 2020/0230967 A1 Jul. 23, 2020

(30) Foreign Application Priority Data

Jan. 18, 2019 (JP) ..... JP2019-006672

(51) Int. Cl.
*B41J 2/175* (2006.01)

(52) U.S. Cl.
CPC ..... *B41J 2/17523* (2013.01); *B41J 2/17513* (2013.01); *B41J 2/17553* (2013.01)

(58) Field of Classification Search
CPC ..... B41J 2/17523; B41J 2/17513; B41J 2/17553; B41J 2/17506
See application file for complete search history.

(56) References Cited

U.S. PATENT DOCUMENTS 6,554,412 B1 * 4/2003 Seino et al. ..... B41J 2/17513
2008/0198211 A1 8/2008 Aoki et al.

FOREIGN PATENT DOCUMENTS

JP 2008-230214 A 10/2008

* cited by examiner

*Primary Examiner* — Lamson D Nguyen
(74) *Attorney, Agent, or Firm* — Oliff PLC

(57) ABSTRACT

A sealing structure for a liquid storage container includes a liquid supplying section having an opening for supplying a liquid in the liquid storage container, and a film member covering the opening. The liquid supplying section includes a flow path forming member having a flow path communicating with the opening, and a sealing member disposed in the flow path, and the flow path forming member has a welding protrusion protruding from a surface of the sealing member on the opening side, the film member is welded to the welding protrusion, and the film member and the sealing member are spaced from each other.

4 Claims, 7 Drawing Sheets

SEALING STRUCTURE AND LIQUID STORAGE CONTAINER

The present application is based on, and claims priority from JP Application Serial Number 2019-006672, filed Jan. 18, 2019, the disclosure of which is hereby incorporated by reference herein in its entirety.

BACKGROUND

1. Technical Field

The present disclosure relates to a sealing structure and a liquid storage container.

2. Related Art

A sealing structure having a thermally-welded film on an opening surface of a liquid supplying section that forms a liquid flow path is described in JP-A-2008-230214. The sealing structure has a sealing member disposed in the liquid flow path of the liquid supplying section.

In this structure, however, the opening surface of the liquid supplying section on which the film is thermally welded and the sealing member are close, and in some cases, welding drips produced by the thermal welding of the film and the liquid guiding section come into contact with the sealing member. In such a case, the sealing member may be deformed by the pressure applied by the welding drips. The deformed sealing member decreases the sealing performance in the flow path in the sealing structure.

SUMMARY

According to an aspect of the present disclosure, a sealing structure for a liquid storage container includes a liquid supplying section having an opening for supplying a liquid in the liquid storage container, and a film member covering the opening. The liquid supplying section includes a flow path forming member having a flow path communicating with the opening, and a sealing member disposed in the flow path, and the flow path forming member has a welding protrusion protruding from a surface of the sealing member on the opening side, the film member is welded to the welding protrusion, and the film member and the sealing member are spaced from each other.

In the sealing structure, a dimension from the surface of the sealing member on the opening side to the top of the welding protrusion may be 0.1 mm or greater and 0.8 mm or less.

In the sealing structure, the flow path forming member may have six regulating protrusions for regulating movement of the sealing member toward the opening side.

In the sealing structure, the film member may be welded also to the regulating protrusions.

According to another aspect of the present disclosure, a liquid storage container includes any one of the above-described sealing structures and a liquid storage communicating with the sealing structure, the liquid storage being configured to store a liquid.

DESCRIPTION OF EXEMPLARY EMBODIMENTS

Embodiments of the present disclosure will be described with reference to the accompanying drawings. It should be noted that in each drawing below, to make each component be a recognizable size, the scale of the component is changed from its actual scale.

Figure 1:
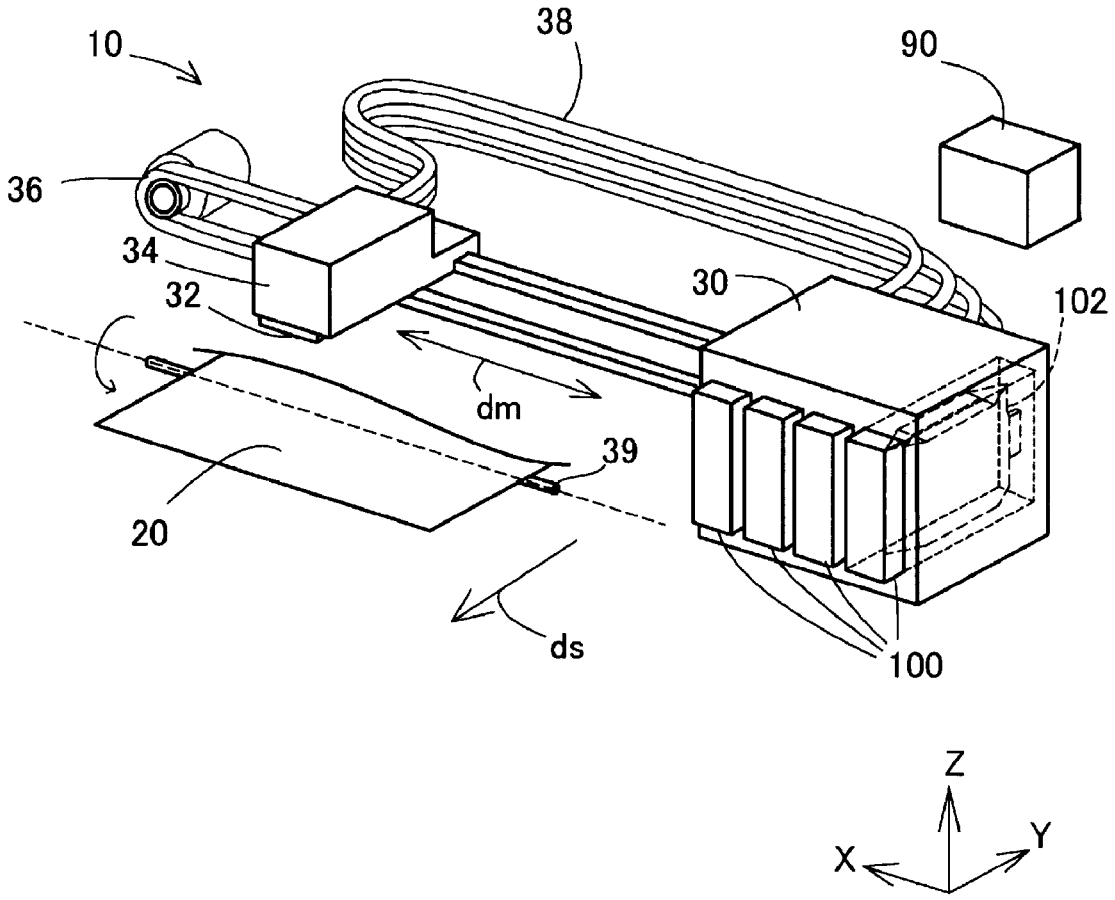
FIG. 1 is a schematic view illustrating a structure of a liquid discharge apparatus.

FIG. 1 is a schematic view illustrating a structure of a liquid discharge apparatus 10. The liquid discharge apparatus 10 discharges a liquid to a medium 20 and allows the medium 20 to hold the liquid on the medium 20. The liquid discharge apparatus 10 is a so-called ink jet printer, and discharges a liquid onto a medium 20 for printing. The medium 20 is a print medium such as paper, plates, or cloths. The liquid may be, for example, an ink, and a water-based ink or a solvent ink may be used. FIG. 1 illustrates an X axis, a Y axis, and a Z axis, which are three spatial axes orthogonal to each other. A direction along the X axis is an X direction, a direction along the Y axis is a Y direction, and a direction along the Z axis is a Z direction. The liquid discharge apparatus 10 is installed on an XY plane that is a plane parallel to the X axis and the Y axis.

The liquid discharge apparatus 10 includes a liquid storage container 100, an attachment section 30 to which the liquid storage container 100 is attached, a carriage 34 having a head 32 for discharging a liquid to the outside, a drive mechanism 36, a transport mechanism 39 for transporting a medium 20, and a controller 90. The drive mechanism 36 drives the carriage 34 in a main scanning direction dm that is along the X axis. The transport mechanism 39 transports a medium 20 in a direction intersecting the main scanning direction dm, for example, in a sub-scanning direction ds that is orthogonal to the main scanning direction dm. The sub-scanning direction ds is a −Y direction. The controller 90 controls various operations of the liquid discharge apparatus 10, for example, a printing operation. The liquid discharge apparatus 10 is an off-carriage ink jet printer. In the off-carriage ink jet printer, the attachment section 30 is not interlocked with the driving of the carriage 34.

The liquid storage container 100 can store a liquid therein. The liquid storage container 100 is detachably attached to the attachment section 30. In the liquid storage container 100, a liquid storage 102 that can store a liquid is disposed. A tube 38 that enables a liquid to flow between the liquid storage 102 and the head 32 is attached. The tube 38 and the liquid storage 102 are connected by a liquid supplying needle (not illustrated) provided in the attachment section 30.

Figure 2:
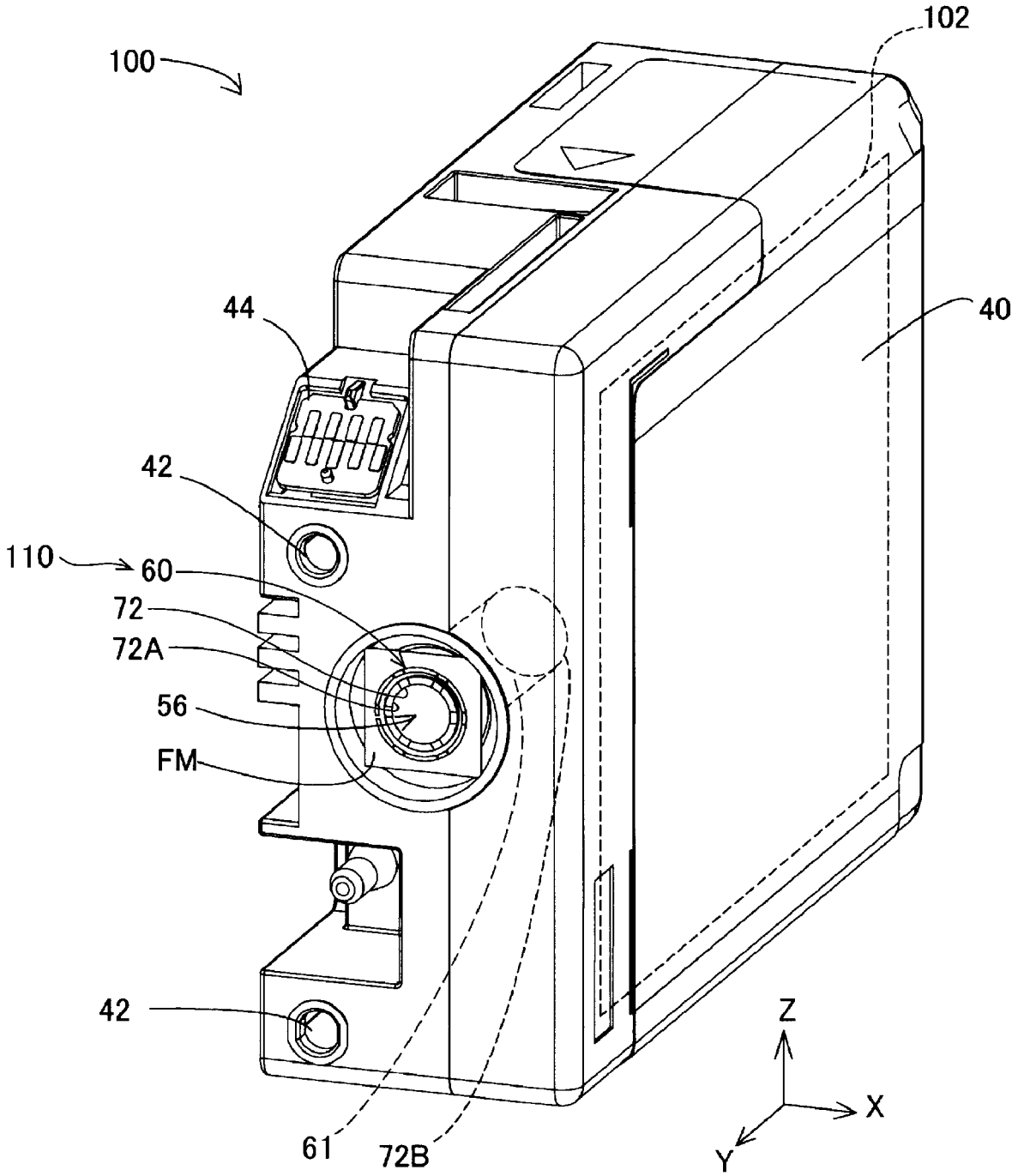
FIG. 2 is a perspective view illustrating a structure of a liquid storage container.
Figure 3:
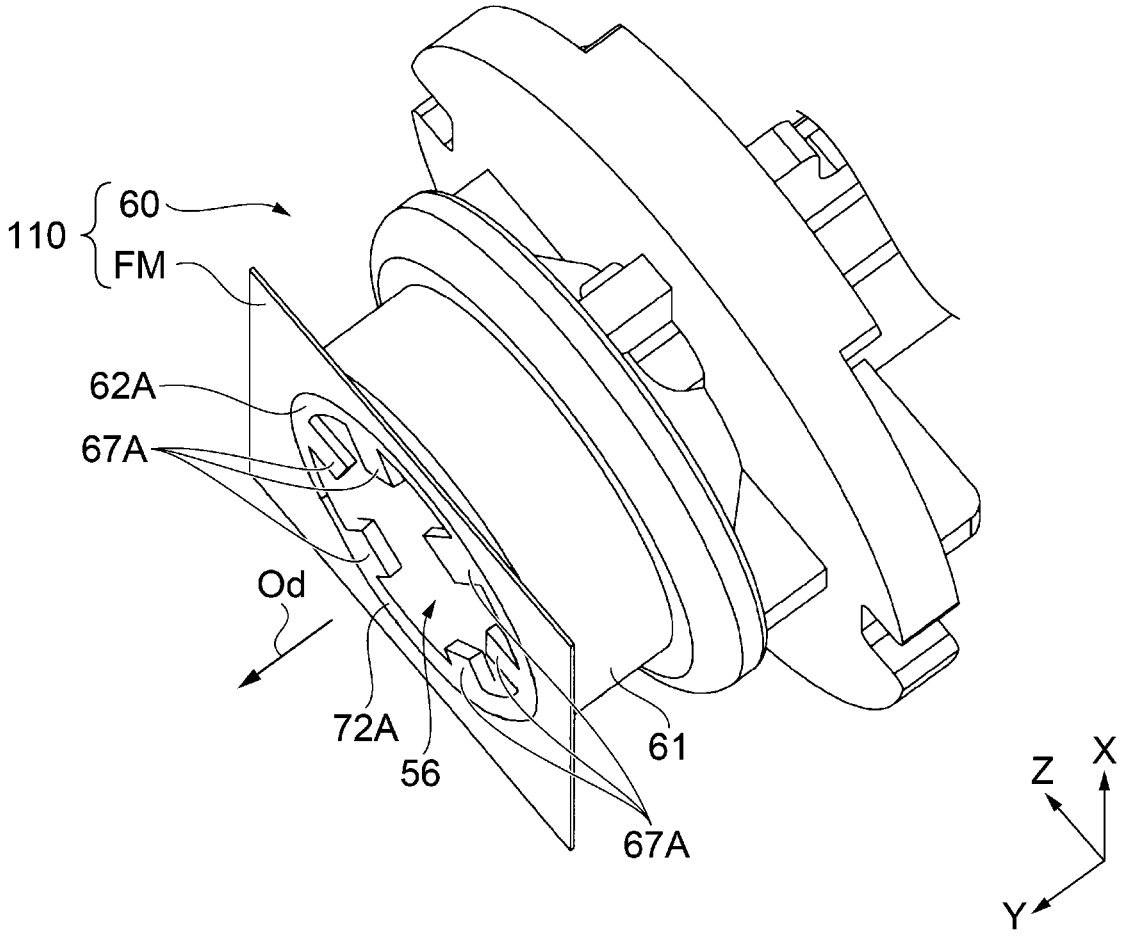
FIG. 3 is a schematic view illustrating a structure of a sealing structure.

FIG. 2 is a perspective view illustrating a structure of the liquid storage container 100. The liquid storage container 100 in FIG. 2 is an unused liquid storage container 100. FIG. 2 illustrates the liquid storage container 100 that is mounted on the liquid discharge apparatus 10 with the X axis, Y axis, and Z axis. FIG. 3 is a schematic view illustrating a structure of a sealing structure 110. As illustrated in FIG. 2 and FIG.

3, the liquid storage container 100 includes the sealing structure 110 and the liquid storage 102. The sealing structure 110 includes a liquid supplying section 60 and a film FM that is a film member. More specifically, the liquid storage container 100 includes a case 40 that is an outer shell, and the liquid supplying section 60 for supplying a liquid stored in the liquid storage container 100 to the liquid discharge apparatus 10. The liquid storage container 100 has the liquid storage 102, which is disposed in the case 40 and is a bag body for storing a liquid therein. The liquid supplying section 60 includes a flow path forming member 61. The flow path forming member 61 includes a flow path 56 that communicates with the inside and the outside of the liquid storage 102. The liquid supplying section 60 and the flow path forming member 61 extend along the Y axis. The flow path 56 has a circular cross section. On one side of the flow path forming member 61, an end portion 72A having an opening 72 is provided. On the other side of the flow path forming member 61, a base end portion 72B is provided. The opening 72 is one end of the flow path 56 for guiding a liquid in the liquid storage 102 to the outside. The base end portion 72B is joined to the liquid storage 102 by welding.

The case 40 is a casing made of synthetic resin such as polypropylene or polyethylene. On outer wall surfaces of the case 40, a positioning section 42 for determining an attachment position with respect to the attachment section 30 and an adapter section 44 used for electrical connection with the liquid discharge apparatus 10 are provided.

In attaching the liquid supplying section 60 to the attachment section 30 of the liquid discharge apparatus 10, a liquid supplying needle of the attachment section 30 is inserted into the liquid supplying section 60. In filling the liquid storage container 100 with a liquid for initial filling, a liquid introduction needle of an initial filling device is inserted into the liquid supplying section 60.

A film FM is attached to the opening 72 of the liquid supplying section 60 in the liquid storage container 100 before use. The film FM covers the opening 72 to seal the flow path 56. The film FM is a thin film member for preventing a liquid to pass through it. The film FM is made of thermoplastic resin, for example, polyolefin-based synthetic resin such as polypropylene or polyethylene. In attaching the liquid storage container 100 to the attachment section 30, the film FM is stuck by the liquid supplying needle of the attachment section 30.

As illustrated in FIG. 3, in the liquid supplying section 60, in attaching the film FM, the film FM is welded onto a welding protrusion 62A and regulating protrusions 67A. The liquid supplying section 60 has six regulating protrusions 67A. As will be described below, before the film FM is welded, the welding protrusion 62A and the regulating protrusions 67A protrude from the end portion 72A in an opening direction Od and provided respectively as a welding protrusion 62 and regulating protrusions 67. The regulating protrusions 67A are disposed at six places at equal intervals in the circumferential direction. In this structure, before an attachment of the film FM by thermal welding, the regulating protrusions 67 are provided at six places with equal intervals in the circumferential direction.

Figure 4:
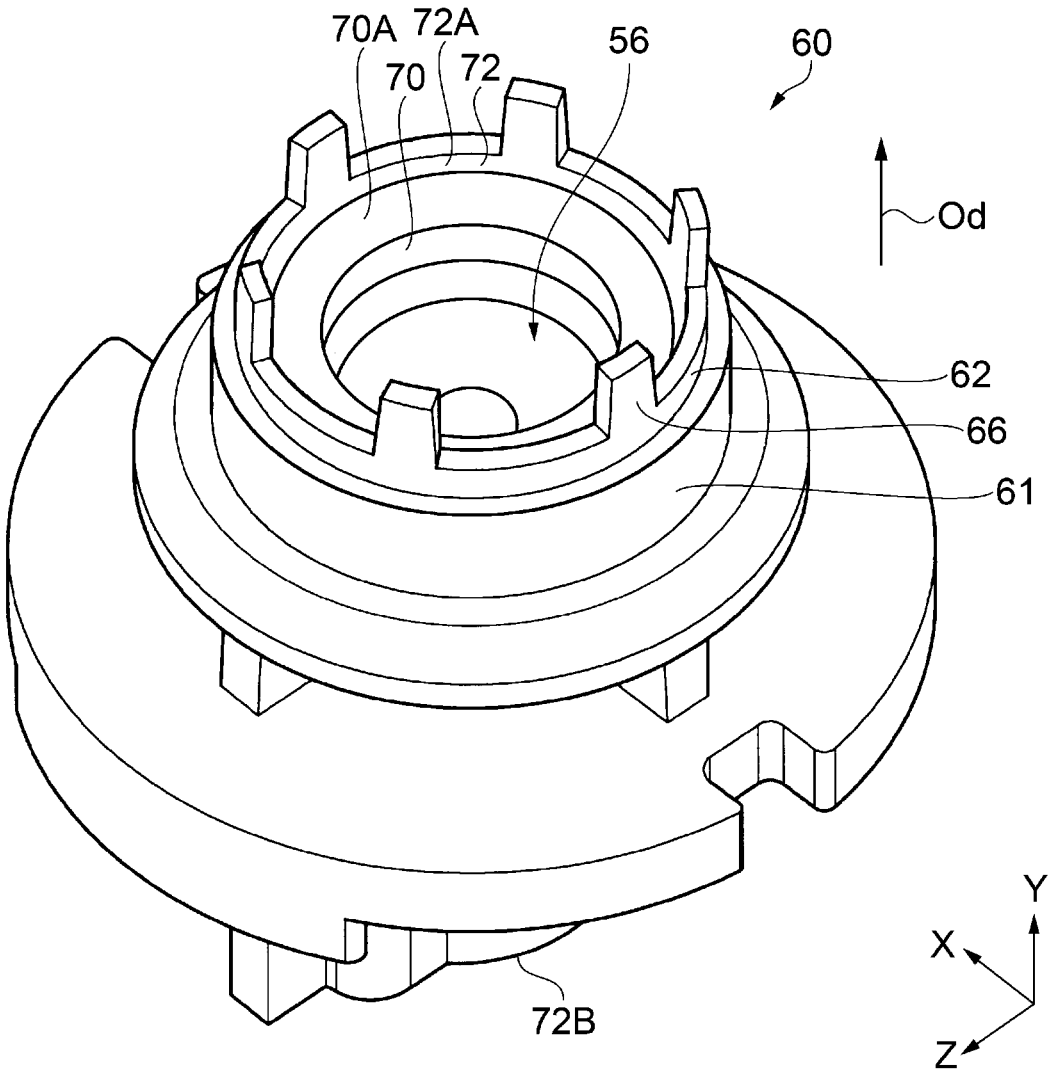
FIG. 4 is a perspective view illustrating a liquid supplying section before a film is attached.
Figure 5:
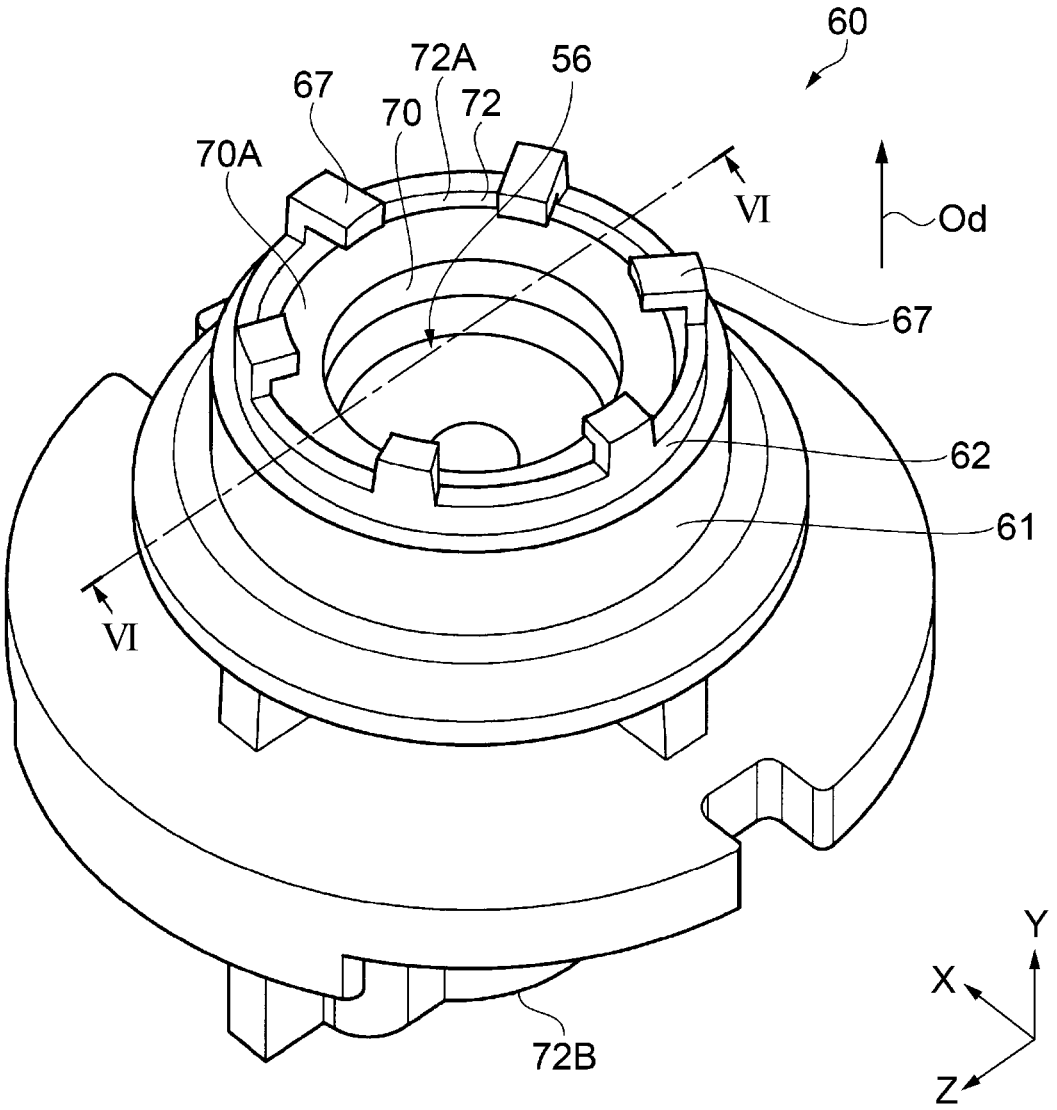
FIG. 5 is a perspective view illustrating a liquid supplying section having regulating protrusions.

FIG. 4 is a perspective view illustrating the liquid supplying section 60 before the film FM is attached. FIG. 5 is a perspective view illustrating the liquid supplying section 60 having the regulating protrusions 67 before the film FM is attached. The liquid supplying section 60 has the flow path forming member 61 and a sealing member 70. The flow path forming member 61 illustrated in FIG. 4 and FIG. 5 is a flow path forming member before welding to which the film FM has not been welded.

The flow path forming member 61 is a substantially cylindrical member that defines the flow path 56. A liquid guided from the inside of the liquid storage container 100 to the outside flows through the flow path 56. The flow path forming member 61 has the welding protrusion 62. The flow path forming member 61 also has six protrusions 66 that serve as the regulating projections 67 as will be described below. The flow path forming member 61 is made of thermoplastic resin that can be welded to the film FM, for example, polyolefin-based synthetic resin such as polypropylene or polyethylene.

The sealing member 70 is disposed in the flow path 56, which is defined by the flow path forming member 61. The sealing member 70 is made of elastic resin, for example, elastomer. The sealing member 70 has an annular shape and defines a valve hole. In attaching the liquid storage container 100 to the attachment section 30, the sealing member 70 is stuck by the liquid supplying needle and comes into contact with the outer peripheral section of the liquid supplying needle, sealing between the liquid supplying needle and the flow path forming member 61. In initial filling, the sealing member 70 seals between the liquid introduction needle, which is inserted for the initial filling, and the flow path forming member 61. With this structure, the sealing member 70 reduces leakage of the liquid from the liquid supplying section 60 in attaching the liquid storage container 100 to the liquid discharge apparatus 10 and in initial filling of liquid to the liquid storage container 100.

The welding protrusion 62 is used for welding with the film FM in attaching the film FM. The welding protrusion 62 is provided on the end portion 72A side of the flow path forming member 61. The welding protrusion 62 protrudes more in the +Y direction, that is, in the opening direction Od than a surface 70A of the sealing member 70 on the opening 72 side. The welding protrusion 62 has an annular shape surrounding the outer circumferential surface of the sealing member 70. The end portion of the welding protrusion 62 is a surface to which the film FM is welded.

As illustrated in FIG. 4, before the film FM is attached, the liquid supplying section 60 has a plurality of protrusions 66 that further protrude in the opening direction Od, that is, the +Y direction, from the welding protrusion 62. Six protrusions 66 are provided in the liquid supplying section 60. The six protrusions 66 are provided at the end portion of the welding protrusion 62 at equal intervals in the circumferential direction.

The welding of the liquid supplying section 60 and a film FM is performed in the following procedure. First, as illustrated in FIG. 5, the protrusions 66 of the liquid supplying section 60 are bent toward the inside of the opening 72, forming the regulating protrusions 67. The regulating protrusions 67 are formed by bending middle portions of the protrusions 66 in the Y direction toward the sealing member 70. The bent end portions of the regulating protrusions 67 are spaced from the surface 70A of the sealing member 70 on the opening 72 side. The regulating protrusions 67 regulate the movement of the sealing member 70 toward the end portion 72A side in the flow path 56. The end portions of the regulating protrusions 67 overlap the surface 70A of the sealing member 70 on the opening 72 side in plan view from the +Y direction. With this structure, when the sealing member 70 moves toward the opening 72, the sealing member 70 comes into contact with the regulating protrusions 67, and thereby the movement of the sealing member 70 is regulated. If the number of the regulating protrusions 67 is less than six, the strength against the pressure during the movement of the sealing member 70 is insufficient, and the regulating protrusions 67 may be damaged, or the attachment stability of the sealing member 70 may be impaired. On the other hand, if the number of the regulating protrusions 67 is seven or more, the space for the regulating protrusions 67 may be insufficient and the cost increases. For the stable manufacturing process, accordingly, it is desirable to provide six regulating protrusions 67.

Then, initial filling of a liquid from the liquid supplying section 60 into the liquid storage container 100 is performed. In the initial filling, a liquid introduction needle of an initial filling device is inserted into the sealing member 70. The sealing member 70 comes into contact with the outer peripheral portion of the liquid introduction needle, and thereby leakage of the liquid to the outside can be reduced or prevented. After the completion of the initial filling, the liquid introduction needle is removed from the sealing member 70. In this process, even if the sealing member 70 moves from the liquid introduction needle side toward the opening 72, the sealing member 70 comes into contact with the regulating protrusions 67, and thus the movement of the sealing member 70 is regulated and the sealing member 70 is prevented from coming out of the flow path forming member 61. Then, the film FM is disposed on the regulating protrusions 67 to cover the opening 72 of the liquid supplying section 60. The film FM and the welding protrusion 62 are thermally welded together. In the welding, the regulating protrusions 67 are also welded to the film FM. The film FM is thermally welded to the welding protrusion 62 and the regulating protrusions 67 for about two or three seconds to about 200° C. During the thermal welding of the film FM and the welding protrusion 62 and the regulating protrusions 67, the welding protrusion 62 and the regulating protrusions 67 are melted and deformed by heat. In the following description, the welding protrusion 62 after the thermal welding is referred to as a welding protrusion 62A, and the regulating protrusions 67 after the thermal welding are referred to as regulating protrusions 67A. The sealing structure 110 includes the welding protrusion 62A and the regulating protrusions 67A. FIG. 3 illustrates the thermally welded film FM, welding protrusion 62A, and regulating protrusions 67A.

Figure 6:
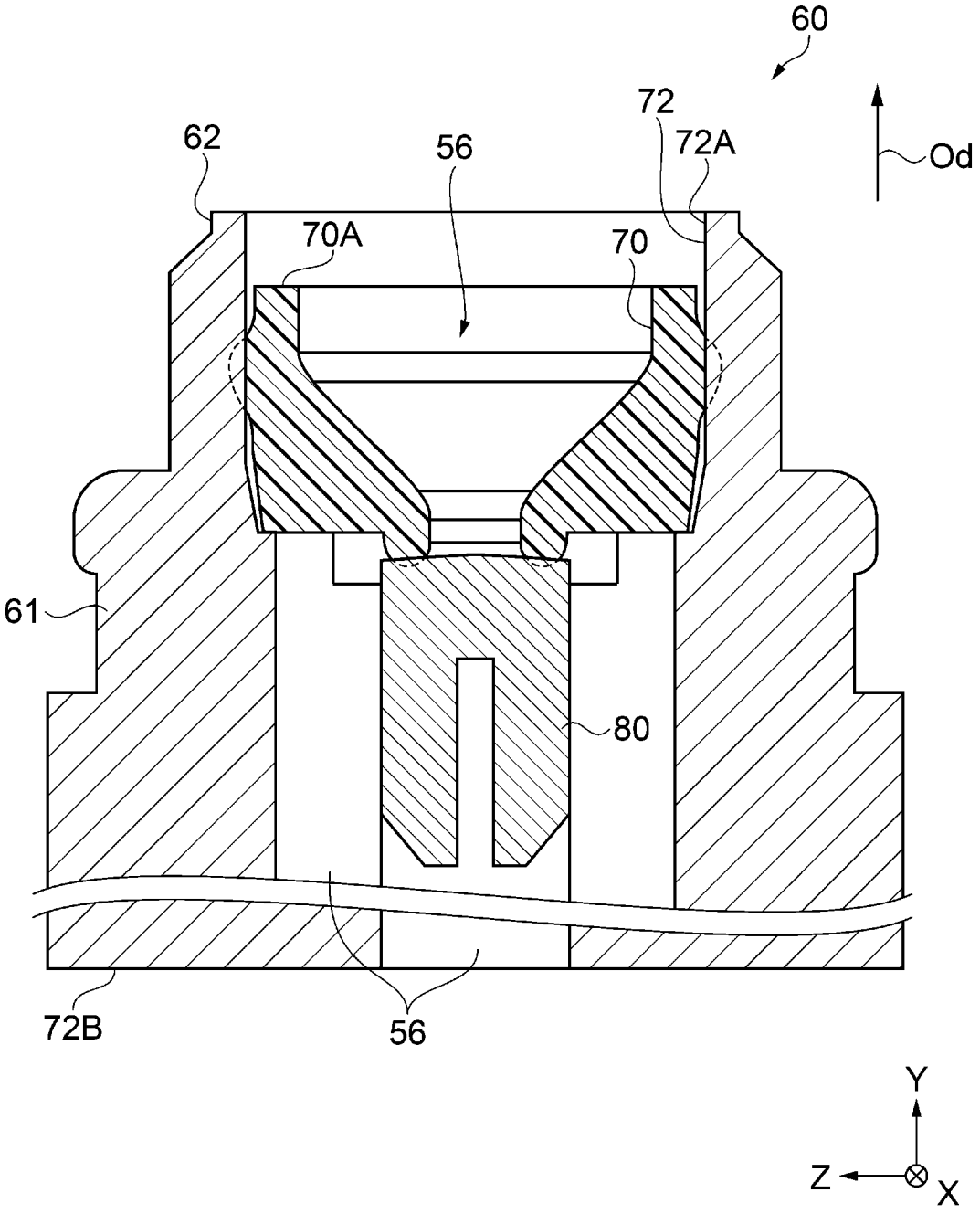
FIG. 6 is a cross-sectional view taken along the line VI-VI in FIG. 5.

FIG. 6 is a cross-sectional view taken along the line VI-VI in FIG. 5. FIG. 6 is, specifically, a cross-sectional view illustrating the liquid supplying section 60 before the film FM is attached. The liquid supplying section 60 includes a valve element 80 in addition to the flow path forming member 61 and the sealing member 70.

The valve element 80 is disposed in the flow path 56 on the side closer to the base end portion 72B than the sealing member 70. The valve element 80 is in contact with the sealing member 70 to seal the valve hole of the sealing member 70 in a state in which the valve element 80 is not pressed by a liquid supplying needle, that is, the liquid storage container 100 is not attached to the attachment section 30. This structure prevents the flow path 56 from communicating with the outside of the liquid storage container 100. The sealing member 70 functions as a valve seat member of the valve element 80 when the liquid storage container 100 is not attached to the attachment section 30. The sealing member 70 thus prevents the liquid in the liquid storage container 100 from leaking outside. The valve element 80 is separated from the sealing member 70 when pressed by a liquid supplying needle. Then, a space is made between the valve element 80 and the sealing member 70, and the flow path 56 communicates with the outside of the liquid storage container 100. In initial filling, the valve element 80 is pressed by the liquid introduction needle. Then, a space is made between the valve element 80 and the sealing member 70, and the flow path 56 communicates with the outside of the liquid storage container 100, enabling the injection of the liquid in the initial filling and a supply of the liquid from the liquid storage container 100 to the liquid discharge apparatus 10.

Figure 7:
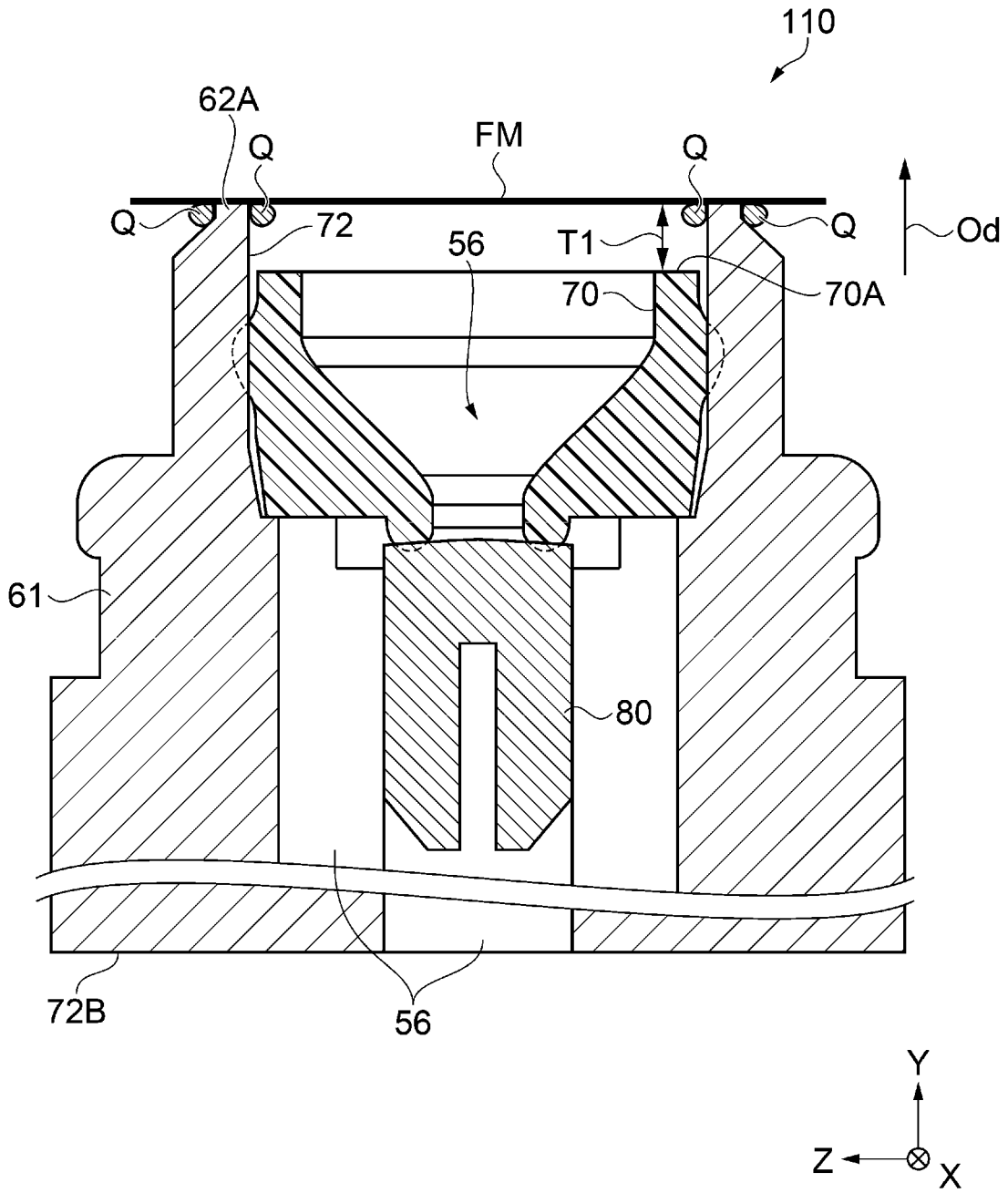
FIG. 7 is a cross-sectional view illustrating a liquid supplying section after a film is attached.

FIG. 7 is a cross-sectional view illustrating the liquid supplying section 60 after the film FM is attached. FIG. 7 illustrates a cross section of the sealing structure 110. As illustrated in FIG. 7, the film FM is welded to the welding protrusion 62A and the regulating protrusions 67A. By the film FM, the opening 72 is covered and the flow path 56 is sealed.

As described above, when the welding protrusion 62 and the regulating protrusions 67 are welded together with the film FM, the welding protrusion 62 and the regulating protrusions 67 are melted by heating. In the thermal welding process, the liquid storage container 100 is disposed in a state in which the opening direction Od of the liquid supplying section 60 attached to the liquid storage container 100 is directed in the +Y direction, and the welding protrusion 62 and the regulating protrusions 67 and the film FM are welded under a constant pressure. During the processing, the welding protrusion 62 and the regulating protrusions 67 are melted together by heat and some portions of the welding protrusion 62 and the regulating protrusions 67 are melted and welding drips Q are produced. The welding drips Q are produced more in the −Y direction than on the surface where the film FM is disposed, and the welding drips Q flow toward the sealing member 70 side of the welding protrusion 62 and toward the side of the welding protrusion 62 opposite to the sealing member 70. The welding drips Q flow downward inside and outside of the opening 72. After the thermal welding processing, the welding drips Q are released from the heat that reached its melting point and are cooled, and the welding drips Q set at or around the end of the welding protrusion 62A in the +Y direction.

In the sealing structure 110, the film FM is spaced from the sealing member 70. The space is formed since the portions of the welding protrusion 62 and the regulating protrusions 67 welded to the film FM protrude more in the +Y direction than the surface 70A of the sealing member 70 on the opening 72 side. The surface 70A of the sealing member 70 on the opening 72 side is, accordingly, not welded to the film FM. Since the welding drips Q set around the welding protrusion 62A are not in contact with the sealing member 70, the sealing member 70 is prevented from being deformed by the welding drips Q. With this structure, reduction in the sealing performance of the sealing member 70 with respect to the liquid storage container 100 due to deformation of the sealing member 70 can be reduced or prevented and leakage of the liquid to the outside can be reduced or prevented. A dimension T1 from the surface 70A of the sealing member 70 on the opening 72 side to the top of the welding protrusion 62A in the +Y direction is 0.1 mm or greater and 0.8 mm or less. Accordingly, between the film FM welded to the welding protrusion 62A and the surface 70A of the sealing member 70 on the opening 72 side, a space between 0.1 mm or greater and 0.8 mm or less is ensured. The dimension T1 may be 0.5 mm or greater and 0.8 mm or less. With the structure, welding drips Q flow downward and set before reaching the sealing member 70. Accordingly, the sealing member 70 can be reliably prevented from coming into contact with welding drips Q, and thus the structure is advantageous in the welding processing in the manufacturing process. The film FM may come into contact with welding drips Q or may not come into contact with welding drips Q.

The flow path forming member 61 has the six regulating protrusions 67A on the opening 72 side (FIG. 3). Welding the regulating protrusions 67 and the film FM forms the regulating protrusions 67A. The end portions of the regulating protrusions 67 overlap the surface 70A of the sealing member 70 on the opening 72 side in plan view. This structure prevents the sealing member 70 from coming out of the flow path forming member 61 in detaching the liquid storage container 100 coupled to the liquid supplying needle of the liquid discharge apparatus 10. It is desirable that the number of the regulating protrusions 67A is six. If the number of the regulating protrusions 67A is less than six, the strength against the movement of the sealing member 70 is insufficient. Furthermore, the regulating protrusions 67A may fail to stably arrange the sealing member 70, and this may cause a problem in the manufacturing process. On the other hand, if the number of the regulating protrusions 67A is seven or more, the space for the regulating protrusions 67A may be insufficient and increase the cost.

Welding drips Q produced by the thermal welding processing and the welding protrusion 62A can be distinguished in the sealing structure 110. The flow path forming member 61 having the welding protrusion 62A is formed by injection molding. On the other hand, welding drips Q are made after the welding protrusion 62 melted by thermal welding processing set. The structure of the welding drips Q, accordingly, is different from the structure of the welding protrusion 62A. The structural difference can be observed, for example, by observing the cross-sectional shapes.

According to the above-described embodiment, the following advantages can be achieved.

The film FM is welded to the welding protrusion 62A, which protrudes more in the +Y direction than the surface 70A of the sealing member 70 on the opening 72 side. The film FM and the sealing member 70 are spaced from each other. With this structure, welding drips Q produced by thermal welding of the film FM and the liquid supplying section 60 set before reaching the surface of the sealing member 70 and are held between the film FM and the sealing member 70. The welding drips Q are not in contact with the sealing member 70 and thus the sealing member 70 is prevented from being deformed by the welding drips Q heated by thermal welding. This structure reduces or prevents deformation of the flow path 56 and a space between the sealing member 70 and the flow path 56 due to the deformation, reducing or preventing leakage of the liquid supplied from the liquid storage container 100 to the liquid discharge apparatus 10 to the outside.

It is to be understood that the present disclosure is not limited to the above-described embodiment, and various modifications and changes of the embodiment can be made. Example modifications will be described below.

Modification 1

The flow path forming member 61 according to the above-described embodiment has the regulating protrusions 67A, however, the regulating protrusions 67A may be omitted. With such a structure, the sealing member 70 and the film FM can also be spaced from each other.

Modification 2

The liquid storage container 100 according to the above-described embodiment is an ink jet printer and a container for supplying ink to the ink jet printer; however, the liquid storage container 100 may be a liquid discharge apparatus for discharging various liquids including ink and liquid tanks for storing the liquids.

Contents derived from the embodiment will be described below.

A sealing structure for a liquid storage container includes a liquid supplying section having an opening for supplying a liquid in the liquid storage container, and a film member covering the opening. The liquid supplying section includes a flow path forming member having a flow path communicating with the opening, and a sealing member disposed in the flow path, and the flow path forming member has a welding protrusion protruding from a surface of the sealing member on the opening side, the film member is welded to the welding protrusion, and the film member and the sealing member are spaced from each other.

With this structure, the film member is welded to a welding protrusion protruding from a surface of the sealing member on the opening side. The film member and the sealing member are spaced from each other. With this structure, welding drips produced by welding of the film member and the liquid supplying section are cooled and set before reaching the film member without reading the film member and are held between the film member and the sealing member. The welding drips are not in contact with the sealing member accordingly and the sealing member is reduced or prevented from being deformed by the welding drips. Accordingly, this structure reduces or prevents a space between the sealing member and the flow path due to the deformation of the sealing member, ensures the sealing performance in the flow path by the sealing member, and reduces or prevents leakage of the liquid to the outside.

In this sealing structure, a dimension from the surface of the sealing member on the opening side to the top of the welding protrusion may be 0.1 mm or greater and 0.8 mm or less.

With this structure, welding drips can be reliably held between the film member and the sealing member and the sealing member can be prevented from coming into contact with welding drips, and in the manufacturing process, stable welding of the film member to the welding protrusion can achieved.

In this sealing structure, the flow path forming member may have six regulating protrusions for regulating movement of the sealing member toward the opening side.

This structure enables the sealing member to be held by the regulating protrusions while preventing the sealing member from coming out of the flow path forming member, for example, in detaching the sealing structure coupled to a liquid supplying needle of a printer. With this structure, liquid leakage can be prevented. The number of the regulating protrusions may be six. The regulating protrusions enable stable attachment of the sealing member. If the number of the regulating protrusions is less than six, the strength against the movement of the sealing member is insufficient and also insufficient for stable attachment of the sealing member. On the other hand, if the number of the regulating protrusions is seven or more, the space for the regulating protrusions may be insufficient and may increase the manufacturing cost.

In this sealing structure, the film member may be welded also to the regulating protrusions.

With this structure, the regulating protrusions have functions similar to those of the welding protrusion and movement of the sealing member can be regulated.

A liquid storage container includes the sealing structure described in any one of the sealing structures and a liquid storage communicating with the sealing structure and configured to store a liquid.

With this structure, in the sealing structure, deformation of the sealing member by welding drips can be reduced or prevented. Accordingly, the sealing performance in the flow path in the sealing structure can be maintained, and leakage of the liquid from the liquid storage container can be reduced or prevented.

What is claimed is:

1. A sealing structure for a liquid storage container, comprising:

a liquid supplying section having:

an opening configured to supply a liquid in the liquid storage container; and a flow path forming member having:

a flow path communicating with the opening;

a welding protrusion that protrudes from the flow path forming member on an opening side; and six regulating protrusions disposed on the welding protrusion;

a sealing member disposed in the flow path, the six regulating protrusions being configured to regulate movement of the sealing member toward the opening side; and a film member that covers the opening, is welded to the welding protrusion, and is spaced apart from the sealing member.

2. The sealing structure according to claim 1, wherein a dimension from the surface of the sealing member on the opening side to a top of the welding protrusion is 0.1 mm to 0.8 mm.

3. The sealing structure according to claim 1, wherein the film member is welded also to the regulating protrusions.

4. The liquid storage container comprising:

the sealing structure according to claim 1; and a liquid storage communicating with the sealing structure, the liquid storage being configured to store a liquid.

* * * * *